US006093901A

United States Patent [19]

Taylor

[11] Patent Number: 6,093,901

[45] **Date of Patent: *Jul. 25, 2000**

[54] MANUALLY OPERATED ACTUATING DEVICE

[75] Inventor: David G. Taylor, Thomasville, Ga.

[73] Assignee: Taylor Maddox Technical, Inc., Thomasville, Ga.

[ * ] Notice: This patent is subject to a terminal disclaimer.

[21] Appl. No.: 09/391,852

[22] Filed: Sep. 8, 1999

Related U.S. Application Data

[63] Continuation-in-part of application No. 09/291,796, Apr. 14, 1999, Pat. No. 5,998,748.

[51] Int. Cl.[7] ..... H01H 33/04

[52] U.S. Cl. ..... 200/331; 200/17 R; 218/12; 337/168

[58] Field of Search ..... 81/53.1; 200/17 R, 200/331; 218/1, 12; 294/19.1, 19.3, 24, 26; 337/156, 168, 171, 174–176, 194, 200, 203, 208, 211–214, 417; 439/476.1, 480, 477, 478, 483, 484

[56] References Cited

U.S. PATENT DOCUMENTS

| | | | |
|---|---|---|---|
| D. 350,447 | 9/1994 | Zinnbauer | D6/500 |
| 2,172,143 | 9/1939 | Lemmon | 200/116 |
| 3,962,770 | 6/1976 | Dooley et al. | 29/203 H |
| 4,433,220 | 2/1984 | Buhler et al. | 200/144 AP |
| 5,151,564 | 9/1992 | Rowe | 200/17 R |
| 5,191,311 | 3/1993 | Webb et al. | 337/168 |
| 5,266,759 | 11/1993 | Dohnal et al. | 200/144 B |
| 5,447,016 | 9/1995 | Baginski et al. | 200/43.11 |
| 5,534,673 | 7/1996 | Lehmann et al. | 218/68 |
| 5,534,858 | 7/1996 | Tinkham | 340/870.7 |
| 5,742,220 | 4/1998 | Scherer | 337/171 |
| 5,861,595 | 1/1999 | Wood et al. | 218/12 |
| 5,998,748 | 12/1999 | Taylor | 200/331 |

*Primary Examiner*—Michael Friedhofer

*Attorney, Agent, or Firm*—Kennedy, Davis & Hodge, LLP

[57] ABSTRACT

An actuating device operated by a hookstick is attached to a manually operated oil circuit recloser switch. The device comprises a cantilever and an affixed switch lever. The cantilever includes a pair of lever arms, each having a hook-shaped receptacle for receiving a hookstick that is used to alternatively open or close the switch. Methods of actuating a manually operated switch in a recloser and lock-out device and modifying such a switch to facilitate manual operation are disclosed.

13 Claims, 5 Drawing Sheets

MANUALLY OPERATED ACTUATING DEVICE

This application is a continuation in part application and claims the benefit of U.S. application Ser. No. 09/291,796, filed Apr. 14, 1999, now U.S. Pat. No. 5,998,748, and entitled MANUALLY OPERATED ACTUATING DEVICE.

INTRODUCTION

This invention relates to manually operated handles for recloser switches and lock outs on pole mounted circuit reclosers used by electric utilities. More particularly, this invention relates to a remotely operated actuating device for affixing to a shaft used to open and close a recloser switch using a hookstick.

BACKGROUND OF THE INVENTION

Commercial and residential electrical power is distributed through electric cables which run along a series of power poles. Many of the poles are strategically mounted with automatic circuit reclosers, which are recognized by electric utilities as essential for achieving an important goal of providing continuity of electric service simply and economically. Some 80 to 95 percent of all system faults on overhead power distribution systems are temporary in nature and last from only a few cycles to a few seconds. These temporary faults are generally caused by wind, lightning, animals, tree branches, and switching surges. Reclosers sense and interrupt fault currents and automatically restore service after momentary outages by restoring current after the temporary fault condition is gone. If a fault is permanent, the recloser locks open after a preset number of operations and isolates the faulted section of the system from the main system.

Reclosers are mounted near the tops of utility poles and are provided with manually operated reclosing levers, also known as manual operating handles. The reclosing levers are used for manually opening and closing the recloser or setting the recloser to lockout after one operation. These manually operated levers are currently operated by a hand-held hookstick that is 30 to 40 feet in length. The hookstick is operated by utility worker either on a pole, in a bucket truck, or on the ground. The utility worker inserts the hookstick into a ring that extends from the end of the lever and is used to actuate the lever by pressing against the ring with the hookstick.

The prior art hookstick-operated levers are difficult and cumbersome to operate. Inserting the hookstick into the ring requires skill and patience. The difficulty of inserting the hookstick into the ring is further complicated by the conditions in which system faults generally occur. High winds and lightning are leading causes of system faults. Therefore, a need to operate a recloser lever often arises during poor weather and at nighttime. Placing the hookstick into a small ring at the top of a utility pole is even more arduous a task in wet, windy, and dark conditions which may cause numerous failed attempts and become time consuming. Time is of the essence in restoration of electrical power. Moreover, safety of utility personnel is a significant concern. Failed attempts to insert a hookstick into a ring increase the personnel's exposure to weather conditions or electrical hazards. The prior art fails to address these problems associated with the hookstick operated recloser lever.

SUMMARY OF THE INVENTION

Accordinly, the present invention solves the deficiencies found in prior art recloser levers operated by a hookstick and a ring-actuated lever. In particular, it is an object of the present invention to provide an effective means to make the operation of recloser levers with a hookstick easier and faster. The present invention accomplishes this goal by eliminating the need to exercise skill and patience in placing a hookstick into a ring actuator.

In accordance with the present invention, and disclosed herein, is an improved device for providing operational control of a recloser lever by a hookstick. The device consists of a cantilever assembly that is adapted to attach to the existing ring of the recloser lever, or to replace the existing recloser lever. Once the actuator device of the present invention is installed, the lever may be actuated without finding and placing the hookstick into the ring. Instead, the improved actuator device will allow a user to engage the hookstick by feeling the cantilever assembly with the hookstick and then moving the hookstick in the desired direction to open or close the recloser or adjust the lockout setting. Thus, the recloser lever may be actuated in a single attempt with less precision than needed for inserting hookstick into a prior art ring.

In another aspect, the present invention provides a method of actuating a manually operated switch recloser and lock-out device mounted on poles of an overhead electrical power distribution system, comprising the steps of (a) engaging a cantilever arm attached at a first end to a switch of a recloser and lock-out switch with a distal end portion of an elongate member; and (b) moving the cantilever arm from a first position to a second position in response to moving the elongated member against the cantilever arm, whereby the cantilever arm moves the switch in the recloser and lock-out device between an open and closed position.

DETAILED DESCRIPTION

Figure 1:
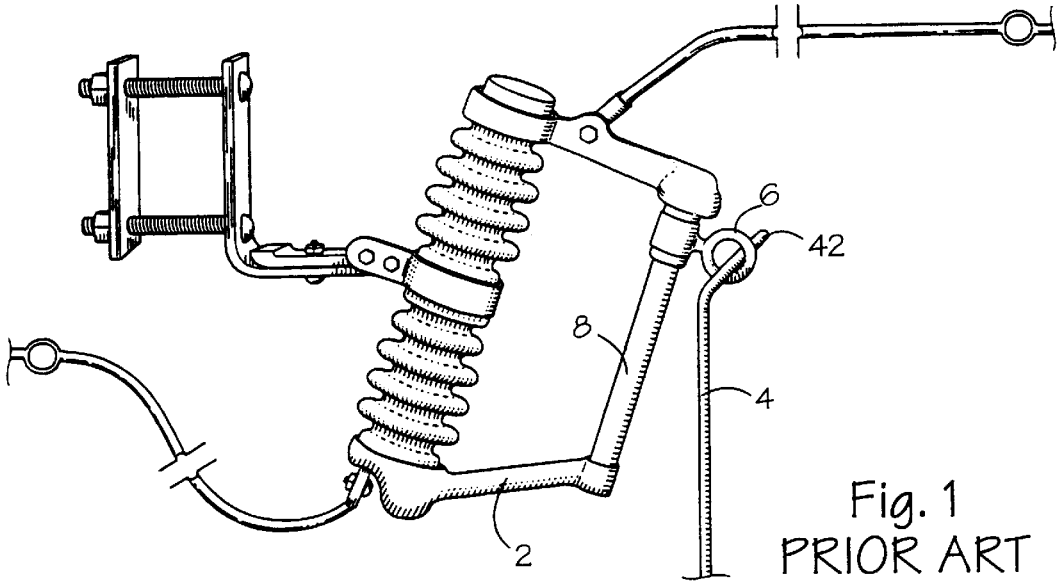
Fig. 1 PRIOR ART
FIG. 1 is a side view of the prior art cutout and arrester combination having a handle and ring manual operating switch.
Figure 8:
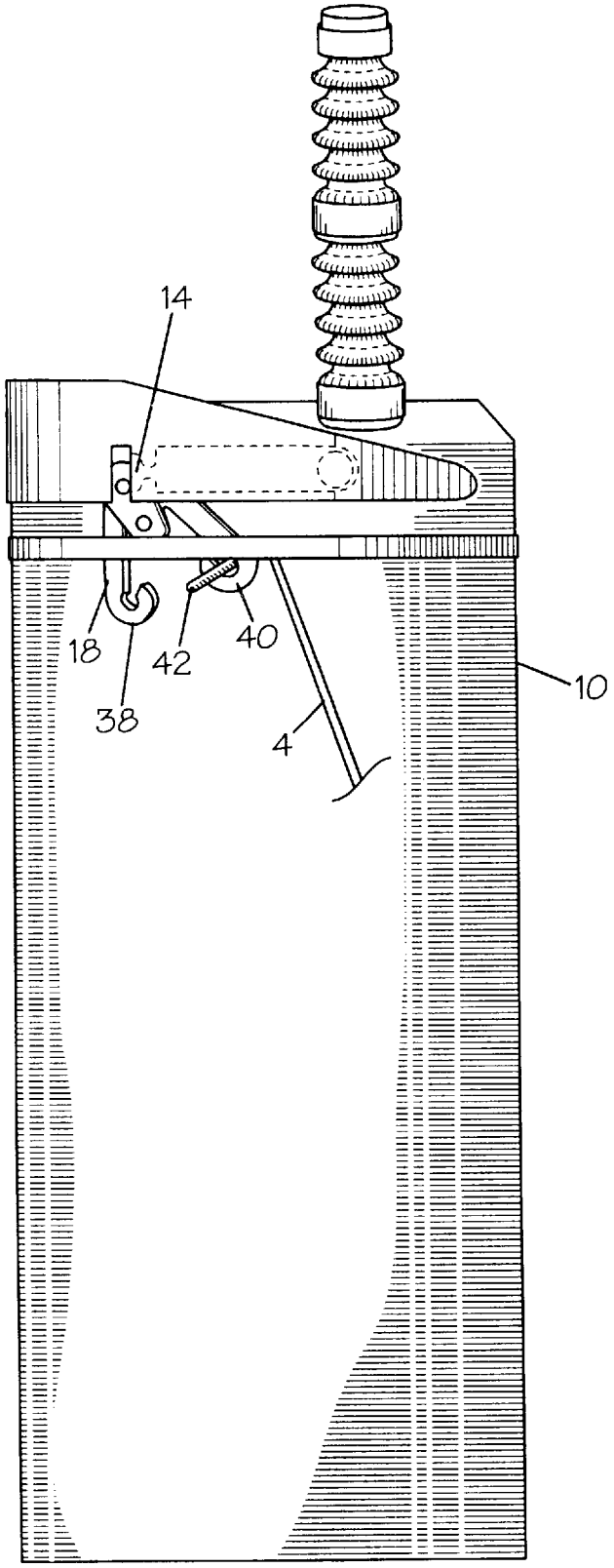
FIG. 8 is side view of the present invention shown attached to a single phase oil circuit recloser.

Referring to the drawings, FIG. 1 illustrates a cutout and arrester combination, also know as a lockout switch or fused cutout switch 2. As shown in FIG. 1, the fused cutout switch is generally operated by manually placing a hookstick 4 in a ring 6 and moving the ring to operate a handle 8 that is used to open or close the cutout switch. An equivalent method is used in the prior art in conjunction with oil circuit reclosers for manually operating a recloser switch. FIG. 8 depicts an oil circuit recloser 10, but with the present actuating device 12 attached thereto.

Figure 2:
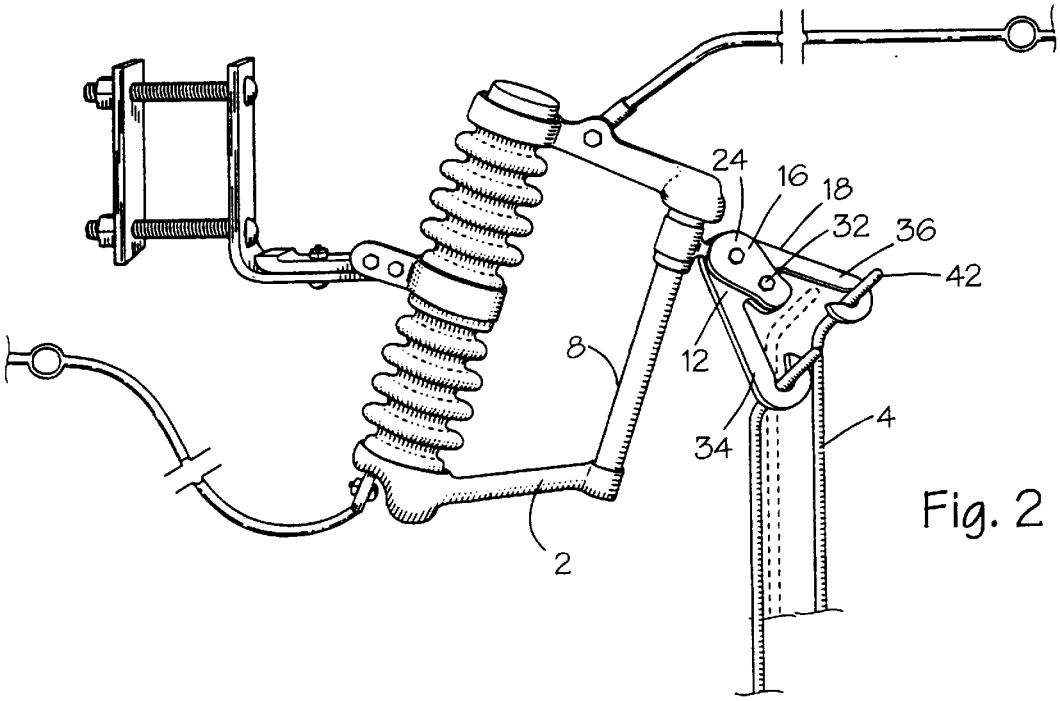
FIG. 2 is a side view of the present invention shown attached to the ring provided on a recloser cutout and arrester combination.

FIG. 2 illustrates a first variation of the actuating device 12 of the present invention as used on the cutout switch 2. In the embodiment shown in FIG. 2, the actuating device, also referred to as a trigger, is attached to the existing ring 6. The same hookstick 4 as used in the prior art is used to open and close the cutout switch by engaging the actuating device in alternate positions on the actuating device as shown in the figure. The ring is caused by the actuating device to move the handle 8 in the same manner as before to actuate the switch, however the switch in more conveniently accessed and operated using the present actuating device.

Figure 10:
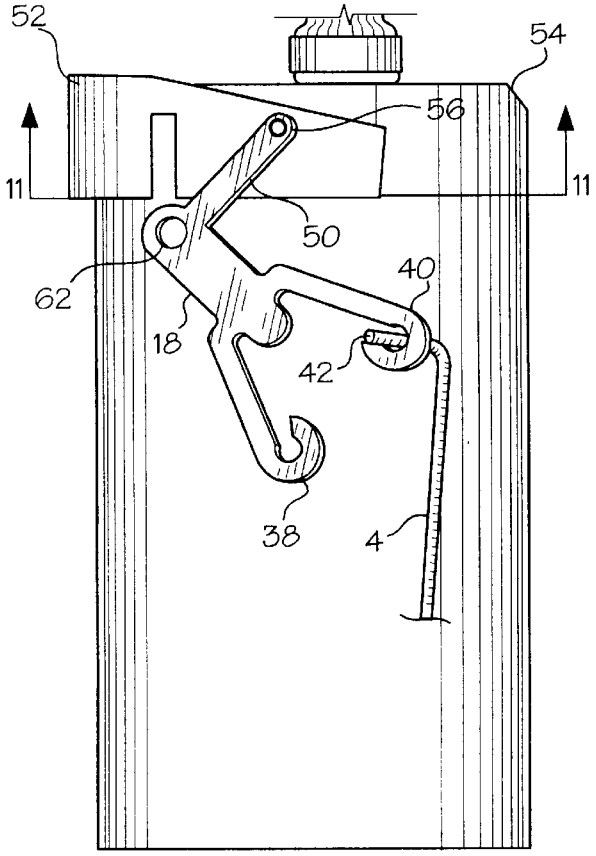

As shown in FIG. 8, the present actuating device also may be used on an oil circuit recloser switch 14 having the same type of ring for engaging the hookstick. The actuating device is used on the oil circuit recloser switch in the same manner as described previously. FIG. 10 illustrates a second variation and embodiment of the invention wherein the ring used by present reclosers is eliminated completely by adapting the present device to connect directly to the recloser.

Figure 3:
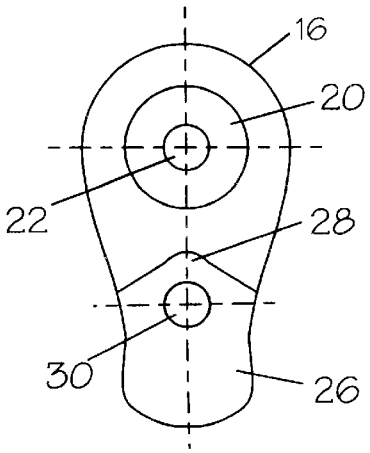
FIG. 3 is a front view of the ring clamp of the present invention.
Figure 4:
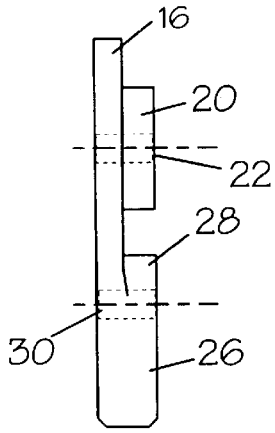
FIG. 4 is a side view of the ring clamp of the present invention.

In the first embodiment of the invention, the actuating device attaches to an existing ring 6 and comprises two primary parts that are bolted together on the ring 6 of a cutout switch 2 or recloser switch 14. The first part consists of a ring clamp 16 having a height of about 3 3/16 inches, and the second part consists of cantilever 18 having a height of about 6 3/8 inches. The ring clamp is shown in detail in FIG. 3 and FIG. 4.

The ring clamp 16 is about ¼ inch thick and has two raised members that increase the thickness of the clamp in those members another ¼ inch to about ½ inch. The first raised member 20 has a circular diameter and fits within the ring 6 such that the ¼ inch raised circular diameter is within the inner diameter of the ring. A first aperture 22 is provided in the first raised member for receiving a bolt 24. The second raised member 26 has a point 28 at the tip of an A-shaped shoulder that bears against the outer diameter of the ring when the clamp is attached to the cantilever 18. A second aperture 30 is provided in the second raised member for receiving a bolt 32.

Figure 5:
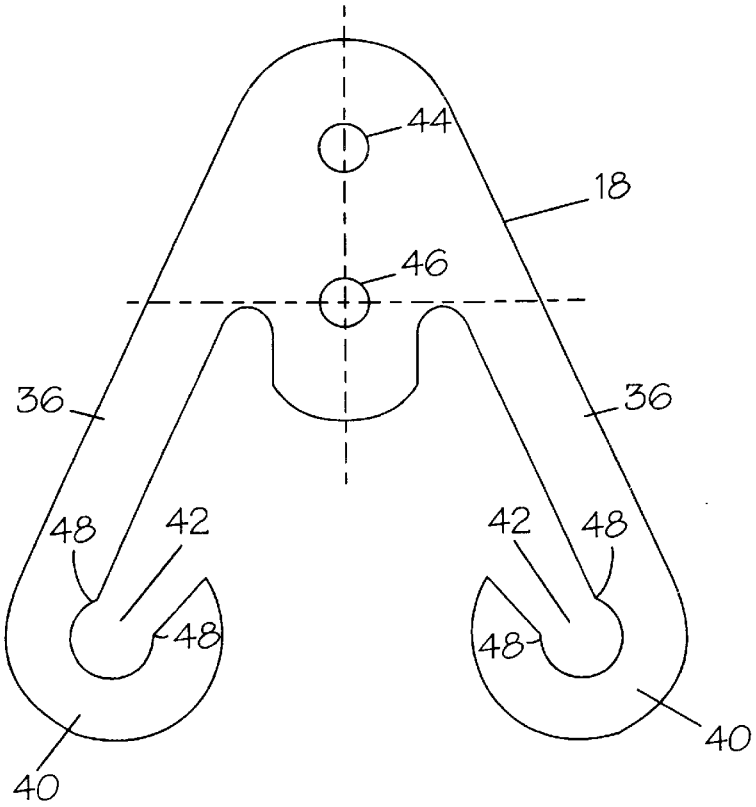
FIG. 5 is a front view of the cantilever of the present invention.
Figure 6:
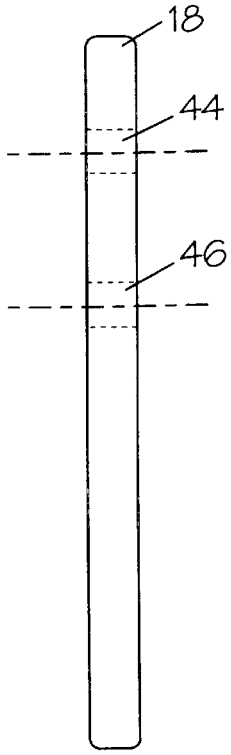
FIG. 6 is a side view of the cantilever of the present invention.

The second part or cantilever 18 is shown in FIGS. 5 and 6. The cantilever part is A-shaped and includes a first lever arm 34 and a second lever arm 36 that oppose each other at an angle. In the embodiment shown, the lever arms are at an acute angle of about 25 degrees to 35 degrees with respect to each other. Each lever arm terminates in a curved hook-shaped receptacle 38 and 40 for receiving a limb 42 at the top of a hookstick 4 like that commonly used to actuate recloser switches. The hook-shaped receptacles each include a receiving slot sized such that the hookstick limb fits into the receptacle. Slight lips 48 may be provided on the receptacles on each side of the receiving slots to hinder the hookstick limb from slipping out of the receptacle while the actuating device 12 is operated.

Figure 7:
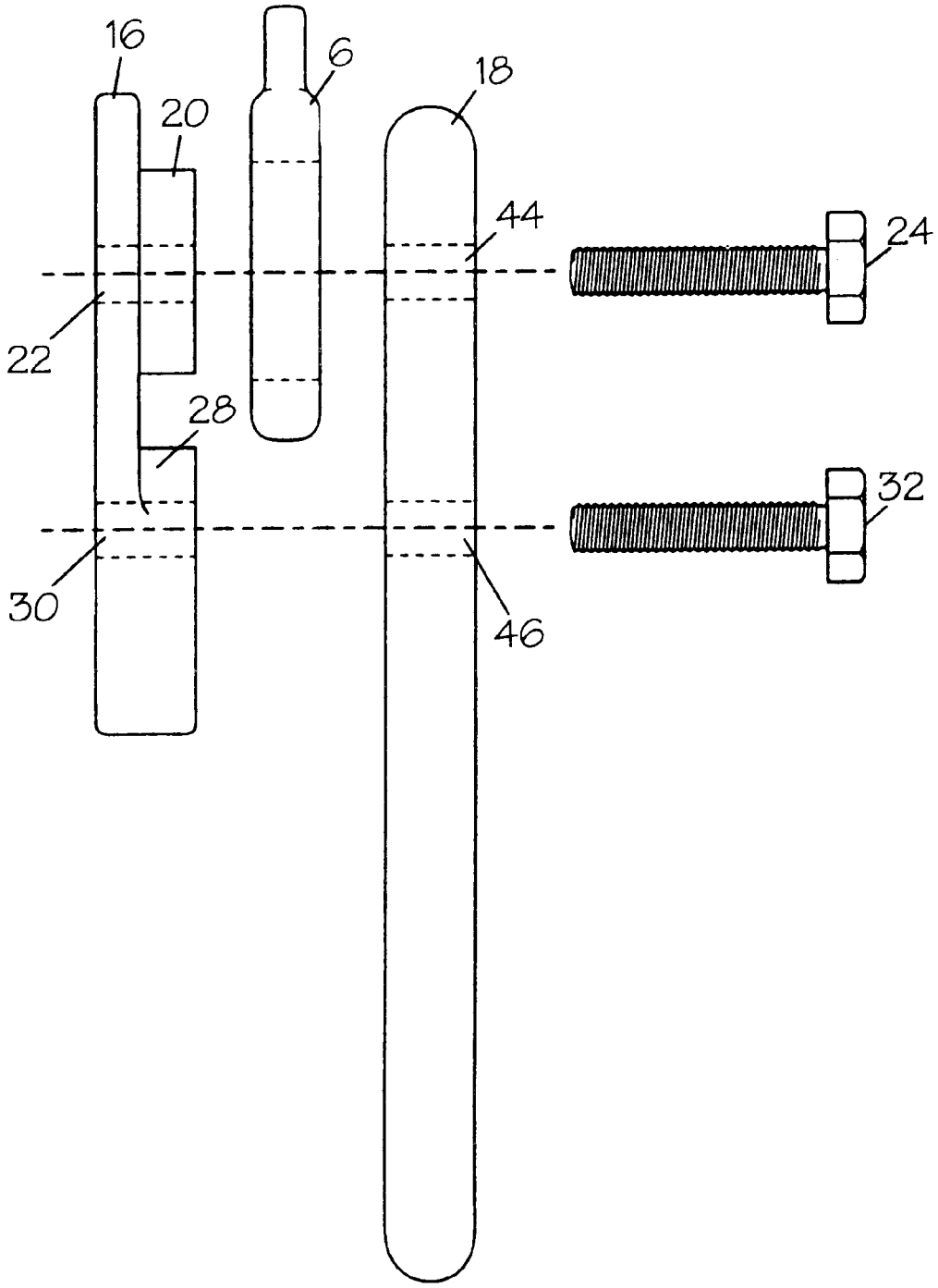
FIG. 7 is an exploded side view of the present invention in relation to the prior art ring.

Apertures 44 and 46 are provided in the cantilever 18. These apertures in the cantilever align with the apertures 22 and 30 on the ring clamp 16. The bolts 24 and 32 are inserted through the apertures of both the cantilever and ring clamp for joining the parts together about a ring 6 as shown in FIG. 7. In lieu of a pair of bolts, a u-bolt or other retaining means could be used for securely attaching the parts to the ring. After the device is attached to the ring, the limb 42 of a standard hookstick 4 is inserted into the receiving slots of the cantilever and the limb is pressed against one of the hook-shaped receptacles 38 or 40 to move the cantilever. As the cantilever is moved, the straight edges of the second raised member 26 of the ring clamp bear against the ring and the cantilever operates the ring 6 and handle 8 to open and close the recloser switch 14 or cutout switch 2.

FIG. 8 depicts the recloser switch lever 50 within the cover 52 in the up position parallel to the top of the recloser cylinder 54. The up position shown in FIG. 8 signifies that the recloser switch is closed. In FIG. 8 the hookstick 4 is shown engaging the actuating device 12 to move switch lever 50 to the down position. The down position is illustrated by the position of the switch lever 50 in FIG. 10 and signifies that the recloser switch is open, which causes the recloser circuit to be open.

Figure 9:
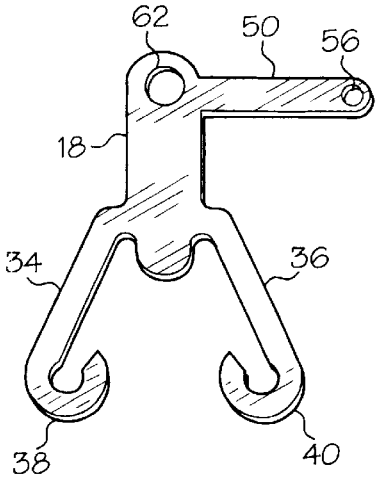
FIG. 9 is a front view of the combination cantilever and switch lever of the present invention.
Figure 11:
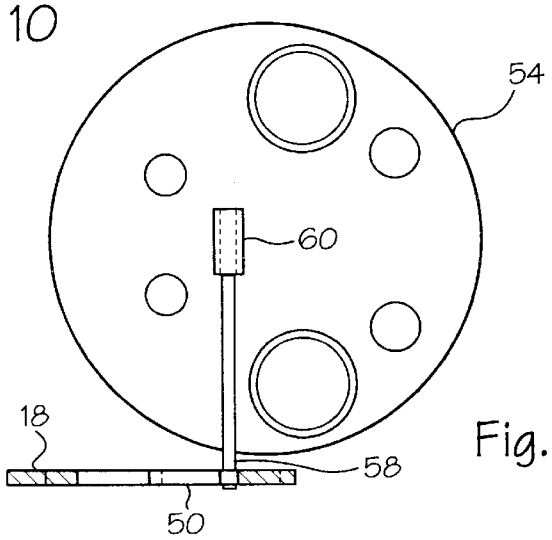
FIG. 11 is a cutaway bottom view along line 11—11 of FIG. 10 of the combination cantilever and switch lever of the present invention attached to the switching shaft of an oil circuit recloser.

The second embodiment of the invention illustrated in FIGS. 9–11 eliminates the ring 6 and incorporates the switch lever 50 into the present invention by attaching or molding the switch lever 50 to the cantilever 18. The original ring structure may be retained by providing a hole 62 at the top of the cantilever 18. The switch lever 50 extends approximately perpendicular several inches out from the cantilever 18. The switch lever includes a threaded hole 56 or other means to connect the switch lever 50 to the end of a shaft 58 or linking means that communicates with the switching mechanisms 60 within the recloser cylinder 54 to cause the recloser circuit to open and close.

While a preferred form of the actuating device 12 of the present invention has been shown in the drawings and described, variations in the invention's embodiment and practice will be readily apparent to those persons skilled in the art. Therefore, the invention should not be construed as limited to the specific form shown and described, but instead is as set forth in the following claims.

I claim:

1. An actuating device for attachment to a manually operated switch comprising:

a cantilever;

a means for attaching said cantilever to said manually operated switch;

said cantilever including a means for receiving a hookstick;

whereby said hookstick moves said actuating device to alternatively open or close said switch.

2. The device of claim 1 wherein said actuating device is attached to a manually operated oil circuit recloser switch.

3. The device of claim 1 wherein said cantilever includes a first lever arm having a terminal end and a second lever arm having a terminal end, said first lever arm and second lever are being angularly disposed with respect to each other.

4. The device of claim 4 wherein said first lever arm is disposed at a 25 degree to 35 degree angle with respect to the second lever arm.

5. The device of claim 4 wherein said means for receiving a hookstick includes a hook-shaped receptacle at the terminal end of said first lever arm and a hook-shaped receptacle at the terminal end of said second lever arm.

6. An actuating device for attachment to a manually operated switch comprising:

a cantilever;

a switch lever affixed to said cantilever;

a means for attaching said switch lever to said manually operated switch;

said cantilever including a means for receiving a hookstick;

whereby said hookstick moves said actuating device to alternatively open or close said switch.

7. A method of actuating a manually operated switch recloser and lock-out device mounted on poles of an overhead electrical power distribution system, comprising the steps of:

(a) engaging a cantilever arm attached at a first end to a switch of a recloser and lock-out switch with a distal end portion of an elongate member; and (b) moving the cantilever arm from a first position to a second position in response to moving the elongated member against the cantilever arm, whereby the cantilever arm moves the switch in the recloser and lock-out device between an open and closed position.

8. The method as recited in claim 7, wherein step (b) comprises moving the distal end of the elongate member into a hook-shaped receptacle at a distal end of the cantilever arm.

9. A method of actuating a manually operated switch of a recloser and lock-out device mounted on poles of an overhead electrical power distribution system, comprising the steps of:

(a) engaging a hook-shaped receptacle at a distal end of a cantilever arm attached at an opposing end to a switch of a recloser and lock-out switch with a distal end portion of an elongate member; and (b) moving the cantilever arm from a first position to a second position in response to bearing the elongated member against the receptacle of the cantilever arm, whereby the cantilever arm moves the switch in the recloser and lock-out device between an open and closed position.

10. A method of modifying a manually operated switch of a recloser and lock-out device mounted on a pole of an overhead electrical power distribution system for facilitating moving the switch between an open and a closed position, comprising the step of attaching a cantilever arm at a first end to a manually operated switch in a recloser and lock-out device, whereby the cantilever arm, being engaged by a distal end portion of an elongated member, is movable from a first position to a second position in order to open and close the switch of the recloser and lock-out device.

11. The method as recited in claim 10, further comprises the step of modifying an arm attached to the switch for engaging the cantilever arm.

12. The method as recited in claim 11, wherein the step of modifying the arm comprises removing a ring attached to the switch.

13. The method as recited in claim 11, wherein the step of modifying the arm comprises the step of the cantilever arm comprises:

providing a clamp having an annular portion received within the ring and a bearing portion bearing against an exterior side of the ring; and securing the cantilever arm to the clamp in an overlying relation to the ring, whereby the ring is sandwiched between the clamp and the cantilever arm.

* * * * *